United States Patent [19]

Eisenbach et al.

[11] 4,104,140

[45] * Aug. 1, 1978

[54] PROCESS FOR THE ELECTROCHEMICAL SYNTHESIS OF ORGANIC METAL COMPOUNDS

[75] Inventors: Wilhelm Eisenbach; Herbert Lehmkuhl; Günther Wilke, all of Mulheim, Ruhr, Fed. Rep. of Germany

[73] Assignee: Studiengesellschaft Kohle mbH, Mulheim, Ruhr, Fed. Rep. of Germany

[ * ] Notice: The portion of the term of this patent subsequent to Jun. 22, 1993, has been disclaimed.

[21] Appl. No.: 690,339

[22] Filed: May 26, 1976

Related U.S. Application Data

[62] Division of Ser. No. 403,239, Oct. 3, 1973, Pat. No. 3,964,983.

[30] Foreign Application Priority Data

Oct. 5, 1972 [AT] Austria ..... 8547/72

[51] Int. Cl.[2] ..... C25B 3/02

[52] U.S. Cl. ..... 204/78; 204/79

[58] Field of Search ..... 204/78–79, 204/59 QM, 59 L

[56] References Cited

U.S. PATENT DOCUMENTS

| | | | |
|---|---|---|---|
| 3,730,857 | 5/1973 | Tripp | 204/59 R |
| 3,964,983 | 6/1976 | Eisenbach et al. | 204/78 |

*Primary Examiner*—R. L. Andrews

*Attorney, Agent, or Firm*—Burgess, Dinklage & Sprung

[57] ABSTRACT

Process for reacting an H-acidic organic compound, in which the acidic H-atom is bonded to the organic radical by an oxygen or a sulphur atom, e.g. an alcohol, with a metal having a standard potential which is more positive than −1.66 volts and which at most incompletely reacts with the H-acidic compound under current-free conditions, e.g. Ni, Co, Fe, Mn, Sb, Cu, or Au. The H-acidic compound or a solution thereof is a polar solvent is made conducting by addition of a soluble salt of chlorine, bromine or iodine, and is electrolyzed at a temperature of up to 150° C, using said metal as the anode, for production of the alcoholate.

15 Claims, No Drawings

PROCESS FOR THE ELECTROCHEMICAL SYNTHESIS OF ORGANIC METAL COMPOUNDS

This is a division of application Ser. No. 403,239, filed Oct. 3, 1973, now U.S. Pat. No. 3,964,983.

The invention relates to a new process for the electrochemical reaction of metals with H-acidic organic compounds, in which the acid H-atom is bonded via an oxygen atom or a sulphur atom to the organic radical. Such H-acidic compounds are more particularly aliphatic, cycloaliphatic and/or aromatic components, which contain hydroxyl groups and/or enolisable keto groups or corresponding functional groups of sulphur. The conception of enolisable keto groups also includes the CO groups of those carboxylic acid ester groups which contain acidic H-atoms in the a-position, for example, with malonic acid diesters. The invention is thus more particularly concerned with the substitution of the acidic H-atom in the said compounds, for example, of the type of aliphatic, aromatic and/or cycloaliphatic alcohols, phenols, enols, 2,4-diketones, 2,4ketocarboxylic acid esters and ketoimino compounds, or corresponding S-compounds, such as mercaptans and thiophenols, by monovalent or polyvalent metal. The H-acidic compounds used according to the invention generally have a pK value in the range up to about 20. The process according to the invention can be employed with advantage, more especially in connection with the reaction of those H-acidic compounds and metals which do not or do not readily take place without use of reaction aids.

The direct reaction of metal and alcohol is merely suitable for the synthesis of alcoholates of very electropositive metals. This is the case with the alkali metals, the alkaline earth metals, and magnesium as well as aluminium. The direct synthesis of metal alcoholates is consequently restricted to metals with a standard potential more negative than about −1.66 volts. Metals having a more positive standard potential (i.e. with a more weakly negative standard potential, but also expressly a positive standard potential) no longer react with alcohols; included in these are for example the following metals (standard potential involts against a standard hydrogen electrode):

| | |
|---|---|
| Mn | (−1.18) |
| Zn | (−0.76) |
| Cr | (−0.71) |
| Fe | (−0.44) |
| Cd | (−0.40) |
| Co | (−0.27) |
| Ni | (−0.23) |
| Pb | (−0.13) |
| Cu | (+0.34) |
| Hg | (+0.79) |
| Ag | (+0.80) |
| Pt | (+1.2) |
| Au | (+1.5) |

The alcoholates of such metals can mainly be obtained by (a) the reaction of metal hydrides, amides or alkyls with alcohols (this applies more especially for zinc alkyls and cadmium alkyls) or (b) the reaction of anhydrous metal chlorides with alkali metal alcoholates or with alcohols, with neutralisation of the forming hydrogen chloride with ammonia, e.g. alcoholates of Ti(IV), Zr(IV), Ge(IV), Sn(IV), Pb(II) (from the iodide), Cr(III), Sb(V) and Sb(III), Mn(II), U(IV), U(V), U(VI), Fe(III).

The disadvantage of the process according to (a) is that it is necessary to start with relatively costly initial materials (e.g. zinc or cadmium alkyls) and that the process cannot be used for a large number of metals, because either the hydrides are not stable (Zn, Cd, Hg, Pd and most of the transition metals) or because the alkyls are not solvolysed by alcohol (Hg, Sn, Pb, Sb) or the alkyls are very unstable (many of the transition metals). The disadvantage of the process according to (b) is that practically valueless alkali halide or ammonium chloride is obtained as secondary product and basic alcoholates are recovered. Since the formation tendency of metal chelate complexes is very great, the synthesis of metal compounds with chelate-forming alcohols, phenols or enols is more easily successful than the synthesis with simple HO compounds, but with the metals which are listed above, not at sufficient speeds.

It is frequently possible here also to start from the freshly prepared metal hydroxides, e.g. for the synthesis of acetylacetonates of nickel or cobalt. In this case, however, water is formed as secondary product, the separation of which is frequently not entirely simple without partial hydrolysis of the products.

It is the object of the invention to make the said H-acid organic O- and/or S-compounds available for the direct reaction with metals, especially when such a reaction has hitherto not been available or sufficiently available for the direct synthesis. The invention solves this problem by the use of electrochemical reaction conditions.

The subject of the present invention is accordingly a process for the reaction of H-acidic organic compounds, of which the acid H-atoms are bonded by way of oxygen and/or sulphur to the organic radical, with metals with which they do not or only incompletely react under current-free conditions, the said process being characterised in that the H-acidic compounds or their solutions in polar solvents are made conducting by adding soluble salts containing chloride, bromide and/or iodide ions and, using as anode the metal of which the compound is to be produced, are electrolysed at temperatures up to 150° C.

The H-acidic compounds of the type set forth are hereinafter designated for the sake of simplicity as "O- and/or S-alcohols", the term "alcohol" being understood here in the broad sense and including more particularly primary, secondary and tertiary aliphatic and aromatic hydroxyl groups, enolisable keto groups or their S-analogues. The reaction products obtained by the process of the invention are then, in this broad sense, "O- and/or S-alcoholates".

The electrochemical gross reaction of the invention can for example be represented by the following reaction equation:

$$nX - H + M \rightarrow MX_n + n/2\ H_2$$

$n$ being an integer from 1 up to the maximum valency of the metal M. Examples for X are then (R = primary, secondary or tertiary alkyl radicals, aryl and/or cycloalkyl radicals, which can also be substituted):

$$RO-;\ RS-;\ \frac{1}{2}-O(CH_2)_nO-;\ \frac{1}{2}-O(CH_2)_nS-$$
$$\frac{1}{2}-S(CH_2)_nS-$$

-continued

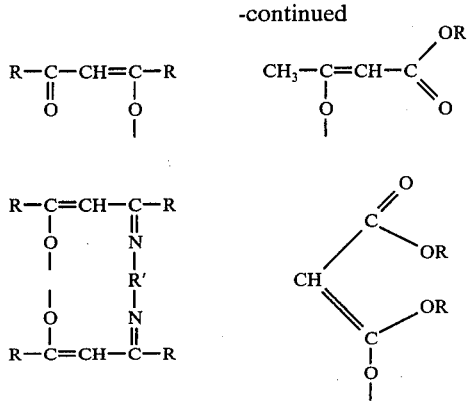

$n$ = an integer, e.g. from 1 to 10;

R′ = organic divalent radical.

B. Szilard already described in 1906, in Zeitschrift fur Elektrochemie 12, page 393, experiments for the electrochemical preparation of individual metal alcholates by electrolysis of a sodium alcoholate solution in methanol or ethanol, using anodes of the metal concerned.

With low current densities and with a relatively short electrolysis, it was possible with magnesium anodes tp detect magnesium ethylate, and with anodes of lead and copper, the corresponding alcoholates, as side or secondary products. According to the information given by the author, tin, antimony and tellurium anodes react in the same manner, but those of zinc and aluminium react much less and there is practically no reaction with iron and chromium anodes. He indicates the noble metals as being insoluble. No statements are made concerning the yields of alcoholates. With rising current density and relatively longer electrolysis, also with low current density, the alkyl formates of the metals are developed, which are formed from the decomposition of the alcoholates by oxidation. Finally, these reactions are only completed with very good cooling. This method is thus generally unsuitable for a preparative production of pure metal alcoholates, more particularly on a relatively large or technical scale, under economic conditions.

The present invention makes use of the fact that, in the presence of the halide ions ($Cl^-$, $Br^-$ and $I^-$) which can be easily oxidised electrochemically, the metals claimed according to the invention readily enter anodically into solution.

With the process of the present invention, therefore, the H-acidic compounds, alcohols, or their solutions in suitable polar solvents, are for example made electrolytically conducting by adding salts which contain halide ions. For raising the conductivity, in addition to the halides, salts with good conducting properties and with difficulty oxidizable anions can also be contained in the electrolyte. Suitable as polar solvents, as well as and together with the H-acidic compounds, particularly aliphatic and cyclic, monobasic, dibasic or polybasic ether, pyridine, dimethylformamide, dimethylsulphoxide, acetonitrile or propylene carbonate are suitable. If the reaction products are stable to hydrolysis under the reaction conditions, then particularly also water as well as mixtures of water with alcohols with the C numbers 1 to 3 or of water with tetrahydrofuran (THF), dimethoxyethane or Diglyme, are suitable.

As halide-containing conducting salts, it is possible with particularly good success to use the chlorides, bromides and the iodides of the alkali metals, of ammonium and also alkylated ammonium. Additives for increasing the conductivity, particularly in the aprotic solvents, such as the ethers, pyridine, dimethylformamide, etc., are perchlorates of the alkali metals or of tetraalkyl ammonium, as well as the corresponding tetrafluoborates or tetraphenylborates and hexafluophosphates.

Used as electrode material for the anodes are those metals of which the compounds are to be produced. All metals which are neutral with respect to the electrolyte, as well as carbon electrodes can be used as cathodes. The standard potential of the metals capable of being used as cathodes should be more positive than −1.66 volts, since otherwise the electrode metal can already be dissolved in a chemical reaction by the alcohol.

The process is also capable of being used at temperatures below 0° C, more particularly for adaptation to the stability of the corresponding O- and/or S-alcoholates. For example, the temperature range to −50° C is suitable, but it is also possible to work below this temperature. In many cases, the temperature range can expediently be between −20° and +150° C, advantageously between 0 and +100° C, for example, for the production of metal compounds of aliphatic alcohols, aromatic OH compounds, enolates, the enolate salts of 2,4-diketones or of 2-keto-4-imino compounds or metal salts of the mercaptans.

Suitable as anode metals are practically all metals which do not react or do not react satisfactorily with the respective O-alcohol or S-alcohol under current-free conditions. Consequently, more particularly involved are metals with a more positive standard potential than −1.66 volts, more particularly the transition metals of the groups IB, IIB, IVB to VIIB and also VIII, and tin, lead, antimony and bismuth.

The metals can be monovalent or polyvalent. If polyvalent metals are used according to the invention, then usually there are formed O-alcoholates or S-alcoholates which, depending on their valency, are bonded several times by way of oxygen or sulphur to organic radicals. The individual valencies of the polyvalent metal can in this case be occupied by like or different organic radicals. Mixed organic metal compounds are obtained when a mixture of different O-alcohols or S-alcohols are introduced in the process.

The O-alcohols and/or S-alcohols can also be monofunctional and/or polyfunctional. Alcohols in the stricter sense are in this case, for example, methanol, ethanol, propanol, isopropanol, butanol, secondary and tertiary butanol, amyl alcohol, octanol, 2-ethylhexanol etc.; polyhydric alcohols, such as glycols, e.g. ethylene glycol, propane-1,3-diol, butane-1,4-diol, pentane-1,5-diol, glycerine, etc., and aromatic compounds with one or more hydroxyl groups.

Enolates can for example be prepared from the following 2,4-diketones or from the analogous 2-keto-4-imino compounds:

Pentane-2,4-dione (acetylacetone)
Alkyl acetoacetate
Alkyl malonate
1,1-Dimethyl cyclohexane-3,5-dione
(Dimedon) or
Ethylene diamino-bis-2-pentan-4-one

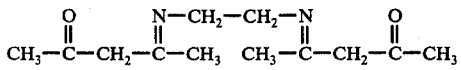

which can be readily obtained by condensation of acetylacetone with ethylene diamine.

Examples of sulphur compounds are ethyl mercaptan, propyl mercaptan, butyl mercaptan, amyl mercaptan, dithioethylene glycol, monothioethylene glycol, thiophenol, etc.. Examples of phenols are phenol, cresol, pyrocatechol, resorcinol, hydroquinone, etc..

The H-acidic compounds which are used according to the invention generally have a pK value up to about 20. Most of these compounds lie in the range from about 5 to 20. Compounds which are particularly suitable can have pK values in the range from about 10 to 20.

Metal alcoholates, metal acetylacetonates and metal enolates are of great technical importance as catalysts or components of catalyst systems, and as auxiliaries or additives in technical processes. Hence, they are in demand as catalysts in connection with the dimerisation of acrylonitrile, a-olefines, butadi-1,3-ene and ethylene, the oligomerisation of butadiene, the polymerisation of for example siloxanes, the cyclomerisation of acetylene, and the co-oligomerisation or for example dienes and ethylene. They also catalyse the epoxidation or hydrogenation of olefins. Acetylacetonates are used as additives in connection with the synthesis of foamed rubber based on polyurethane or in connection with the synthesis of polyethylene terephthalate. The products which are produced by the present process are auxiliaries in connection with the impregnation of textiles, they have an insecticidal action, they are used as dyes and drying agents, they are additives in galvanic baths, rust-removing agents, reducing agents in preparative organic chemistry or starting substances for, for example, multi-component oxide glasses. They are also suitable as additives in benzines and oils. They catalyse the combustion of light and heavy oils and act as soot-destroying agents. They are added as combustion accelerators to jet and rocket fuels.

EXAMPLE 1

Description of the cell I

In an electrolysis cell having 2 vertical metal electrodes which are arranged at a spacing of approximately 20 mm and which each have an effective electrode surface of about 0.2 $dm^2$, the electrolysis reactions are conducted without a diaphragm. The shaft of a stirrer mechanism consisting of electrically insulating material also extends between the electrodes, the blades of said stirrer mechanism rotating beneath the electrodes and in this way providing for a thorough mixing effect.

A solution of 4.4 g of lithium perchlorate and 0.25 g of LiCl in 130 ml of absolute ethanol is electrolysed at 25° C in an electrolysis cell of type I between two nickel electrodes at 500 mAmp (2.5 $A/dm^2$) and 10 volts. Within 3½ hours, 760 Nml (34 mMOl) of hydrogen are generated, corresponding to a current quantity of 1.75 ampere-hours, this being 100% of the theoretical. The experiment is stopped after 22 hours. The employed current quantity of 10.45 ampere-hours corresponds to a dissolving of the nickel anode of 11.75 g, i.e. 100% of the theoretical. The reaction product forms a suspension in the electrolyte; the solution is accordingly decanted, the residue is boiled up in 250 ml of ethanol and, after the filtration, is again washed twice with 50 ml of ethanol.

Yield: 26.7 g, i.e. 90% of the theoretical of nickel ethylate $C_4H_{10}NiO_2$ (148):

Ni calculated: 39.45; found: 40.20.

H calculated: 6.70; found: 6.55.

The compound is insoluble in ethanol.

EXAMPLE 2

A solution of 9 g of $LiClO_4$ and 0.75 g of LiCl in 150 ml of butanol is electrolysed between two cobalt electrodes at 25° C.

Current intensity: 0.5 ampere

Voltage: 23 to 25 volts

Current quantity: 9.3 ampere × hours

Conductivity: $2.1 \cdot 10^{-3}\ \Omega^{-1}\ cm^{-1}$

Anode loss: 10.86 g of Co, i.e. 100%.

The suspension of the reaction product is filtered and washed with 230 ml of butanol.

After drying, there are obtained 31.8 g of cobalt butanolate, i.e. 90% of the theoretical.

$C_8H_{18}CoO_2$ (205):

Co calculated: 28.7; found: 29.8.

In the reaction with acetylacetonate, 80% of the theoretical of butanol are obtained.

EXAMPLE 3

2 g of NaCl are dissolved in a mixture of 60 ml of water and 50 ml of methanol with 40 ml of acetylacetone. This electrolyte is electrolysed at 25° C between two iron electrodes.

Current intensity: 0.25 to 0.5 ampere

Voltage: 8 volts

Current quantity: 3.3 ampere × hours

Conductivity: $8.3 \cdot 10^{-3}\ \Omega^{-1}\ cm^{-1}$

Anode loss: 3.18 g, i.e. 93% of the theoretical.

The reaction mixture is filtered and the residue is dried at 40° C/0.001 mm Hg.

$C_{10}H_{14}FeO_4$ (254); melting point 174° C:

Fe calculated: 22.00; found: 21.96.

C calculated: 47.25; found: 47.20.

H calculated: 5.52; found: 5.54.

The ferrous acetylacetonate crystallising as yellowish-brown needles from absolute ethanol changes into ferric acetylacetone on being heated in acetylacetone with access of oxygen.

If air or oxygen is allowed to bubble through the electrolyte after completing the electrolysis, it is possible to isolate ferric acetylacetonate quantitatively.

$C_{15}H_{21}FeO_6$ (353); melting point 182° C:

Fe calculated: 15.82; found: 15.73.

C calculated: 50.95; found: 50.86.

H calculated: 5.95; found: 6.25; red crystals.

EXAMPLE 4

A mixture of 60 ml of distilled water, 50 ml of ethanol and 40 ml of acetylacetone is made conducting by adding 2 g of KCl and electrolysed in cell I between two cobalt electrodes.

Current intensity: 0.5 ampere

Voltage: 7 volt

Current quantity: 5.8 ampere × hours

Conductivity: $10^{-2}\ \Omega^{-1}\ cm^{-1}$

Anode loss: 6.54 g, i.e. 100%.

The pink-coloured reaction product, which is difficultly soluble in the electrolyte, is filtered off, washed with $H_2O$—$C_2H_5OH$ and dried at 40°/0.1 mm Hg.

Quantity: 17.5 g, i.e. 63% of the theoretical of cobalt-(II) acetylacetonate, bluish-violet crystals.

$C_{10}H_{14}CoO_4$ (257):

Co calculated: 22.90; found: 22.90.

C calculated: 46.70; found: 46.80.

H calculated: 4.45; found: 4.40.

EXAMPLE 5

A solution of 12.9 g of $LiClO_4$ and 2.5 g of LiBr, and including 75.4 g of acetylacetone, in 100 ml of dimethoxyethane, is electrolysed between two nickel electrodes in a cell of the type I.

Current intensity: 0.5 ampere

Voltage: 15 volts

Current quantity: 5.65 ampere × hours

Anode loss: 6.3 g, i.e. 100%.

The deposit is filtered off, washed with dimethoxyethane and dried at 40° C/0.1 mm Hg. Yield: 10 g, i.e. 36% of the theoretical.

It is better to wash out the crude product on the frit with water until it is no longer possible to detect any $Br^-$ in the discharging washing water. The yield of green nickel-(II)-acetylacetonate then increases to 87%.

EXAMPLE 6

A solution of 13.6 g of LiCl in 1457 ml of absolute ethanol is electrolysed at 20° C between two iron electrodes.

Current intensity: 5.0 ampere current density: 5 A/dm$^2$

Voltage: 9.5 volt

Current quantity: 53 A.h

Conductivity: $6 \cdot 10^{-3}\Omega^{-1}cm^{-1}$

Anode loss: 55.2 g, i.e. 100% of the theoretical.

The reaction mixture is filtered and the very fine particulate air-sensitive residue is dried at 60° C/0.001 mm Hg.

Quantity: 136.5 g, i.e. 95% of the theoretical of ferrous ethylate.

$C_4H_{10}FeO_2$ (146):

Fe calculated: 38.30; found: 39.0%.

EXAMPLE 7

A solution of 6.7 g of ethylene-diamino-bis-acetylacetone and 0.11 g of LiCl in 90 ml of acetonitrile is electrolysed at 20° C between a nickel anode and a platinum cathode.

Current intensity: 0.26 - 0.13 ampere

Voltage: 62.5 volts

Current quantity: 1.37 ampere × hours

Conductivity: $5.4 \cdot 10^{-4}\Omega^{-1}cm^{-1}$

Anode loss: 1.20 g of Ni, i.e. 81% of the theoretical.

The solution is concentrated under vacuum and 50 ml of distilled water are added to the residue, which is stirred and filtered and washed until free from $Cl^-$ ions. Toluene is added to the still moist residue, which is dried with $Na_2SO_4$ and filtered. After the solution has been concentrated to a quarter of the volume, red needles crystallise out of the dark-red solution at 0° C; quantity 4.5 g, i.e. 62.4% of the theoretical of nickel-(II)-bis-[ethylenediamino-bis-acetylacetonate].

$C_{12}H_{18}NiO_2N_2$ (281); melting point 198° C:

Ni calculated: 21.00; found: 21.10.

Mass spectrum e/m: 280, 169.

EXAMPLE 8

The same electrolyte solution as described in Example 7 is electrolysed at 40° C between a cobalt anode and a carbon cathode.

Current intensity: 0.4 ampere

Voltage: 62.5 volts

Current quantity: 1.55 ampere × hours

Conductivity: $8 \cdot 10^{-4}\Omega^{-1}cm^{-1}$

Anode loss: 1.35 g, i.e. 80% of the theoretical.

The electrolyte is concentrated by evaporation under vacuum and the dry residue is taken up in 75 ml of toluene; the solution is filtered off from the undissolved substance and the solution is concentrated to a quarter of the original volume. On cooling to about 0° C, orange-coloured prisms are developed; quantity: 4.3 g. i.e. 66.5% of the theoretical of cobalt-(II)-bis[ethylenediamino-bis-acetylacetonate].

$C_{12}H_{18}CoO_2N_2$ (281); melting point: 182° C:

Co calculated: 20.90; found: 20.90.

Mass spectrum e/m: 281, 238 - 281 — $CH_3CO$, 170, 157, 143, 125, 113, 112.

Description of the cell of type II

The diaphragm cell required in some experiments consists in principle of two horizontally disposed flanged vessels (internal diameter 80 mm, capacity about 500 ml) with ground joints for accommodating the lead-ins for stirrer shafts and thermometer anions, between which is tensioned a holding means for the diaphragm and the electrodes.

This holding means consists of two polypropylene rings (external diameter 130 mm, internal diameter 75 mm and thickness 15 mm), on to which the electrodes are screwed on one side. On the other side, they are provided with a recess for accommodating the diaphragm. When assembling the apparatus, the diaphragm is tightly tensioned between the two rings and fixed at a spacing of 6 mm from the electrode. The sealing in the outward direction is effected by a Viton-A cord ring.

The approximately rectangular electrodes (40 × 90 mm) — the short sides are rounded off corresponding to a radius of 90 mm — are arranged vertically in the finally assembled cell. As a result, there is a free space alongside the electrode, so that the electrolyt which is circulated by means of blade-type stirrers in the electrolyt chamber situated behind them, is able to flow between electrodes and diaphragm.

EXAMPLE 9

A solution consisting of 0.95 g of lithium perchlorate and 0.045 g of lithium chloride in a mixture of 39.4 g of THF and 43.3 g of acetylacetone is electrolysed at 22° C between two manganese electrodes.

Current intensity: 300, falling to 45 m.amp

Voltage: 60 volts

Current quantity: 4.9 ampere × hours

Conductivity: $1.1 \cdot 10^{-3}\Omega^{-1}cm^{-1}$

Anode loss: 5.88 g of Mn, i.e. 117% of the theoretical, related to a dissolution of the Mn anode as Mn(II).

The suspension of a light-yellow solid substance is filtered through a D4 frit and the deposit is washed four times, each time with 20 ml of THF.

Quantity: 23.2 g, i.e. 86% of the theoretical of manganous acetylacetonate.

$C_{10}H_{14}MnO_4$ (253.0):

Mn calculated: 21.80; found: 21.10

EXAMPLE 10

A solution of 79.2 g (0.84 mol) of phenol, 5.3 g of lithium perchlorate and 0.6 g of lithium chloride in 100 ml of THF is electrolysed at 20° C between two cobalt electrodes.

Current intensity 0.5 ampere
Voltage: 32 to 36 volts
Current quantity 9.64 ampere × hours
Conductivity: $1.1 \cdot 10^{-3}\Omega^{-1}cm^{-1}$
Anode loss: 11.14 g of Co, i.e. 105% of the theoretical, related to the transition of Co metal to Co(II).

The suspension of the reaction product is filtered through a D2 frit, and the deposit is washed three times, each time with 15 ml of THF, and dried.

Quantity: 38.6 g, i.e. 83.5% of the theoretical of cobalt-(II)-phenolate.

$C_{12}H_{10}CoO_2$ (245):
Co calculated: 24.10; found: 24.60.

EXAMPLE 11

The procedure is as described in Example 5, but the nickel electrodes are replaced by cobalt electrodes and electrolysis takes place at 50° C.

Current intensity: 0.5 ampere
Voltage: 10 volts
Current quantity: 5.8 ampere × hours
Anode loss: 6.55 g, i.e. 100% of the theoretical
Quantity: 19.0 g, i.e. 67% of the theoretical of cobalt-(II)-acetylacetonate.

$C_{10}H_{14}CoO_4$ (257):
Co calculated: 22.90; found: 22.90.

EXAMPLE 12

The procedure is as described in Example 11, the electrolysis taking place in Diglyme ($CH_3OCH_2CH_2OCH_2CH_2OCH_3$) at 80°-100° C and, after the electrolysis, a mixture of air and oxygen is introduced into the electrolyte. Green cobalt-(III)-acetylacetonate is obtained with a yield of 89% of the theoretical.

$C_{15}H_{21}CoO_6$ (356): Co calculated: 16.55; found: 16.85.

EXAMPLE 13

The procedure is as described in Example 5, but propylene carbonate (electrolysis temperature 40° C) is used as solvent.

Yield of nickel-(II)-acetylacetonate: 80% of the theoretical.

EXAMPLE 14

The procedure is as described in Example 5, but the solvent used is pyridine, dimethylsulphoxide, dimethylformamide or acetonitrile; yield of nickel-(II)-acetylacetonate: 68% of the theoretical; 45% of the theoretical; 89% of the theoretical and 75% of the theoretical, rspectively.

EXAMPLE 15

A solution of 2.55 g of LiCl or 8 g of LiI in a mixture of 100 ml of absolute ethanol and 100 ml of diethylmalonate is electrolysed between two nickel electrodes at 20° C.

Current intensity: 0.22 ampere
Voltage 7.0 volts
Current quantity: 9.4 ampere × hours
Conductivity: $1.2 \cdot 10^{-3}\Omega^{-1}cm^{-1}$ (LiCl)
Anode loss: 10.0 g, i.e. 98% of the theoretical, related to the current quantity.

During the electrolysis, 2.3 Nl of hydrogen were formed on the cathode, i.e. 59% of the calculated quantity.

After filtration, there are obtained 31 g of

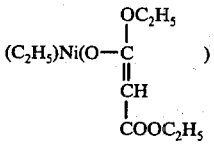

If this product is heated for a relatively long time in excess malonic ester and then the formed ethanol and excess malonic ester are distilled off, there is obtained, as a light-green solid substance:

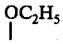

$C_{14}H_{22}O_8Ni$ (377.04):
Calculated: Ni 15.6; found: 16.0.

On heating with acetylacetone, nickel acetylacetonate is formed and also the correct quantity of malonic ester.

EXAMPLE 16

Using a cell of type II, a solution of 13 g of tetrabutyl ammonium bromide in 1800 ml of methanol is electrolysed, using a cathode consisting of Fe and an antimony anode.

Current intensity: 0.5 ampere
Voltage: 12 to 17 volts
Current quantity: 13.4 ampere × hours
Anode loss: 20 g of antimony, i.e. 99% of the theoretical, based on a transition from Sb(0) to Sb(III).

There are obtained 31.5 g of trimethoxy antimony, i.e., 88% of the theoretical, as a crystalline substance with a melting point of 123° to 124° C.

EXAMPLE 17

In a cell of type II, a solution of 20 g of tetrabutyl ammonium bromide in 1800 ml of THF, after addition of 200 g of ethyl acetoacetate, is electrolysed at 30° C between two copper electrodes. After the passage of 10.9 ampere × hours, there is obtained a dissolution of the copper anode of 85% of the theoretical and it is possible from the anolyte to isolate cuprous ethyl acetoacetate after recrystallisation from benzene in the form of green needles. Melting point 192° C.

EXAMPLE 18

62.3 g (1 mol) of ethyl mercaptan are dissolved in 165 g of THF electrolyte with 0.2 mol/liter of LiCl and 1.0 mol/liter of $LiClO_4$ and electrolysed between two Co electrodes in a cell corresponding to the previously described type I.

Temperature: 24° C
Current intensity: 300 mA
Voltage 15 Volts
Current quantity: 6.4 A.h. = 240 mF
Specific conductivity: $2.2 \cdot 10^{-3}\Omega^{-1}cm^{-1}$
Electrode loss: 6.13 g = 104 mg At
In the electrolysis, two products are formed:

1. a dark-green solid, which can be filtered off — Product I — and 2. a compound which is soluble in the electrolyte and which can be isolated as a dirty-violet solid — Product II —.

Product I: 14.0 g (58 mMol):

$C_6H_{15}S_3Co$ (242.3) Co calculated: 24.32%, found: 24.0%

Product II: 7.5 g (41.4 mMol):

$C_4H_{10}S_2Co$ (181.2) Co calculated: 32.53%, found: 30.6%

Total yield, related to dissolved Co = 95%.

EXAMPLE 19

A mixture of 160 ml of THF, 77 g (1 mol) of propane-1,3-diol, 1,3 g of LiCl and 17.0 g of $LiClO_4$ is electrolysed in an electrolysis cell as in Example 18 between two cobalt electrodes.

Specific conductivity: $7.3 \cdot 10^{-3}\Omega^{-1}cm^{-1}$ at 25° C

Current intensity: 500 mA

Voltage: 11.5 - 12.0 volts

Current quantity: 8.35 A.h. $\approx$ 311.6 mF

Anode loss: 9.18 g = 155.7 mg At, i.e. 100% of current yield.

The suspension, which is a deep violet-brown colour, is separated from the colourless filtrate. After drying, a pale violet powder is obtained.

Yield: 19.9 g, i.e. 96%, based on anode loss.

$C_3H_6O_2Co$ (133.04): Co calculated: 44.31, found: 43.5.

EXAMPLE 20

27.5 g (250 mMol) of resorcinol are dissolved in an electrolyte consisting of 200 ml of absolute ethanol and 2.2 g of LiCl. This mixture is electrolysed between two cobalt electrodes in the same cell as in Example 18.

Specific conductivity: $1.21 \cdot 10^{-3}\Omega^{-1}cm^{-1}$ at 20° C

Current intensity: 500 mA

Voltage: 36.5 - 38.0 volts

Current quantity: 4.8 A.h. = 178.6 mF

Anode loss: 5.15 g = 87.46 mg At: 100% anode current yield

Some cobalt has been deposited on the cathode, so that the effective current yield, i.e. related to the metal which has entered into solution, amounts to 81%.

From the deep-blue reaction solution, after separation of the excess resorcinol and the conducting salt, it is possible to obtain a dark blue product which is soluble in ethanol; quantity: 9.5 g, i.e. 80%, based on the cobalt which has entered into solution. $C_6H_4O_2Co$ (167.0) Co calculated: 35.28%, found: 34.8%.

EXAMPLE 21

The diaphragm cell described as type II is used as electrolysis cell. The electrolytes consist of:

Anode chamber:

600 ml of ethanol 5.1 g of LiCl 75 ml (1 mol) of ethyl mercaptan

Cathode chamber:

700 ml of ethanol 6 g of LiCl.

A gold sheet serves as anode, while a platinum sheet is used as cathode. The anode is also provided with a scraper, in order to scrape off any deposit which may possibly be formed.

Specific conductivity: $3.65 \cdot 10^{-3}\Omega^{-1}cm^{-1}$

Current intensity: 155 - 200 mA

Voltage: 13.5 - 12.0 volts

Current quantity: 1.0 A.h. = 37.3 mF

Anode loss: 7.2 g = 36.55 mg At, i.e. 98%, based on the transition of $Au \rightarrow Au^+$ The voluminous, white deposit is separated from the electrolyte by filtration, washed with ethanol and dried.

Yield: 9.0 g = 95%, based on gold loss.

$C_2H_5SAu$: Au calculated: 76.32%, found: 75.4% (258.09)

We claim:

1. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions, wherein the H-acidic compound or its solution in polar solvent is made conducting by addition of a soluble salt containing as the anion thereof, at least one of chloride, bromide and iodide and is electrolysed at a temperature up to 150° C, using said metal as the anode, and at least one of alkali perchlorates, ammonium perchlorates, and tetrafluoborates, tetraphenylborates, and hexafluophosphates is used with the salt.

2. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions, wherein a solution of the H-acidic compound in a polar solvent is made conducting by addition of a soluble salt containing ions of at least one of chloride, bromide and iodide and is electrolysed at temperatures up to 150° C, using said metal as the anode, the polar solvent being water or a mixture of water with at least one water-soluble organic compound, the electrolysis for said reaction being conducted in the presence of said polar solvent, and the reaction product of the H-acidic compound and the metal anode is recovered, the reaction product being stable to hydrolysis under reaction conditions.

3. Process according to claim 2, where the polar solvent is a mixture of water and at least one of tetrahydrofuran, dimethoxyethane, diethylene glycol dimethyl ether, and aliphatic or cyclic monobasic, dibasic or polybasic ether, pyridine, a tertiary amine, acetonitrile, dimethylsulphoxide, propylene carbonate, and dimethylformamide.

4. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions, wherein the H-acidic compound or its solution in polar solvent is made conducting by addition of a soluble salt containing ions of at least one of chloride, bromide and and iodide and is electrolysed at temperatures up to 150° C, using said metal as the anode, wherein the H-acidic compound is pentane-2,4,-dione, alkyl acetoacetate, alkyl malonate,1,1-dimethyl cyclohexane-3,5-dione, or ethylene diamino-bis-2-pentan-4-one.

5. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions, wherein the H-acidic compound or its solution in polar solvent is made conducting by addition of a soluble salt containing ions of at least one of chloride, bromide and iodide and is electrolysed at temperatures up to 150° C, using said metal as the anode, wherein the H-acidic compound is ethyl mercaptan, propyl mercaptan, butyl mercaptan, amyl mercaptan, dithioethylene glycol, monothioethylene glycol, or thiophenol.

6. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions, wherein the H-acidic compound or its solution in polar solvent is made conducting by addition of a soluble salt containing ions of at least one of chloride, bromide and iodide and is electrolysed at temperatures up to 150° C, using said metal as the anode, wherein the H-acidic compound is phenol, cresol, pyrocatechol, resorcinol, or hydroquinone.

7. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions, wherein the H-acidic compound or its solution in polar solvent is made conducting by addition of a soluble salt containing ions of at least one of chloride, bromide and iodide and is electrolysed at temperatures up to 150° C, using said metal as the anode, wherein the H-acidic compound is acetylacetone.

8. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions, wherein the H-acidic compound or its solution in polar solvent is made conducting by addition of a soluble salt containing ions of at least one of chloride, bromide and iodide and is electrolysed at temperatures up to 150° C, using said metal as the anode, wherein the H-acidic compound is ethylenediamino-bis-acetylacetone.

9. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions, wherein the H-acidic compound or its solution in polar solvent is made conducting by addition of a soluble salt containing ions of at least one of chloride, bromide and iodide and is electrolysed at temperatures up to 150° C, using said metal as the anode, wherein the H-acidic compound is diethylmalonate.

10. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions, wherein the H-acidic compound or its solution in polar solvent is made conducting by addition of a soluble salt containing ions of at least one of chloride, bromide and iodide and is electrolysed at temperatures up to 150° C, using said metal as the anode, wherein the H-acidic compound is ethylacetoacetate.

11. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions and is of the group ruthenium, rhodium, palladium, osmium, iridium, platinum, antimony, bismuth, silver, gold, cadmium, mercury, molybdenum, tungsten, tecnecium, and rhenium, wherein the H-acidic compound or its solution in polar solvent is made conducting by addition of a soluble salt containing ions of at least one of chloride, bromide and iodide and is electrolyzed at temperatures up to 150° C, using said metal as the anode.

12. A process according to claim 11, wherein said metal is of the group antimony, bismuth, cadmium, mercury, silver, platinum, gold.

13. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions, wherein the H-acidic compound or its solution in polar solvent is made conducting by addition of a soluble salt containing ions of at least one of chloride, bromide and iodide and is electrolysed at temperatures up to 150° C, using said metal as the anode, wherein the H-acidic compound is at least one of an aromatic compound, a cycloaliphatic compound, a mercaptan, an enol, a phenol, a thiophenol, a 2,4-diketone, a 2,4-ketocarboxylic acid ester, a carboxylic acid ester with acidic hydrogen in the $\alpha$-position, and a ketoimino compound.

14. Process according to claim 13, wherein the H-acidic compound is a mercaptan.

15. Process for the reaction of an H-acidic organic compound in which the acidic H-atom is bonded by oxygen or sulphur to the organic radical and which has a pK value of up to about 20, with a metal having a standard potential which is more positive than −1.66 volts and which does not or only incompletely reacts with the H-acidic compound under current-free conditions, wherein a solution of the H-acidic in a polar solvent is made conducting by addition of a soluble salt containing ions of at least one of chloride, bromide and iodide and is electrolysed at temperatures up to 150° C, using said metal as the anode, the polar solvent being at least one of tetrahydrofuran, dimethoxyethane, diethylene glycol dimethyl ether, an aliphatic or cyclic monobasic, dibasic or polybasic ether, pyridine, a tertiary amine, acetonitrile, dimethylsulphoxide, propylene carbonate, and dimethylformamide.

* * * * *

UNITED STATES PATENT AND TRADEMARK OFFICE

CERTIFICATE OF CORRECTION

PATENT NO. : 4,104,140

DATED : August 1, 1978

INVENTOR(S) : Wilhelm Eisenbach, Herbert Lehmkuhl and Gunther Wilke

It is certified that error appears in the above-identified patent and that said Letters Patent are hereby corrected as shown below:

Column 2, line 6, change "Pd" to --Pb--.

Column 3, line 55, change "difficulty" to --difficultly--.

Column 10, lines 18,19 and 20, correct the formula to read --

$$Ni[-\overset{\overset{\displaystyle OC_2H_5}{|}}{O}C=CH-COOC_2H_5]_2$$ --.

Signed and Sealed this

Sixth Day of March 1979

[SEAL]

*Attest:*

RUTH C. MASON
*Attesting Officer*

DONALD W. BANNER
*Commissioner of Patents and Trademarks*